United States Patent [19]

Greifer

[11] Patent Number: 4,612,935

[45] Date of Patent: Sep. 23, 1986

[54] COMFORT ACCESSORIES FOR BRASSIERES

[76] Inventor: Claire R. Greifer, 217 E. Sedgwick St., Philadelphia, Pa. 19119

[21] Appl. No.: 661,506

[22] Filed: Oct. 16, 1984

[51] Int. Cl.[4] ..... A41D 27/10; A41C 3/06

[52] U.S. Cl. ..... 128/510; 2/268

[58] Field of Search ..... 2/268, 322, 323, 73, 2/DIG. 6, 2; 128/510

[56] References Cited

U.S. PATENT DOCUMENTS

| | | | |
|---|---|---|---|
| 1,478,773 | 12/1923 | Stocker | 2/323 |
| 2,055,094 | 9/1936 | Zweben | 2/42 |
| 2,619,650 | 12/1952 | Lerma | 2/268 |
| 2,649,639 | 8/1953 | Carlin | 2/323 |
| 2,671,217 | 3/1954 | Studler | 2/42 |
| 2,782,418 | 2/1957 | Garson | 2/42 |
| 2,882,907 | 4/1959 | Puliafico | 128/492 |
| 3,154,787 | 11/1964 | Newman | 2/268 |
| 4,472,838 | 9/1984 | Pompa | 2/268 |
| 4,481,682 | 11/1984 | Hall | 2/DIG. 6 |

FOREIGN PATENT DOCUMENTS 74089 10/1948 Norway .

*Primary Examiner*—Doris L. Troutman

*Attorney, Agent, or Firm*—Caesar, Rivise, Bernstein & Cohen, Ltd.

[57] ABSTRACT

Comfort accessories for use with a conventional brassiere having a pair of shoulder straps. The accessories comprise shoulder strap adjusting means as well as shoulder strap pressure diffusing means. The shoulder strap adjusting means is arranged to adjust the position of at least one of the shoulder straps with respect to the wearer's shoulders and comprises an elongated flexible strip having loop means located at each end. Each loop means is arranged to extend and hold a portion of at least one of the shoulder straps so that the position of the shoulder strap is adjusted with respect to the shoulder. The pressure diffusing means is arranged to spread pressure applied by the shoulder strap across the wearer's shoulder and comprises pad means which are releasably secured by fastening means to one of the shoulder straps. The pad means is interposed between shoulder strap and the shoulder of the wearer.

6 Claims, 11 Drawing Figures

FIG. 1
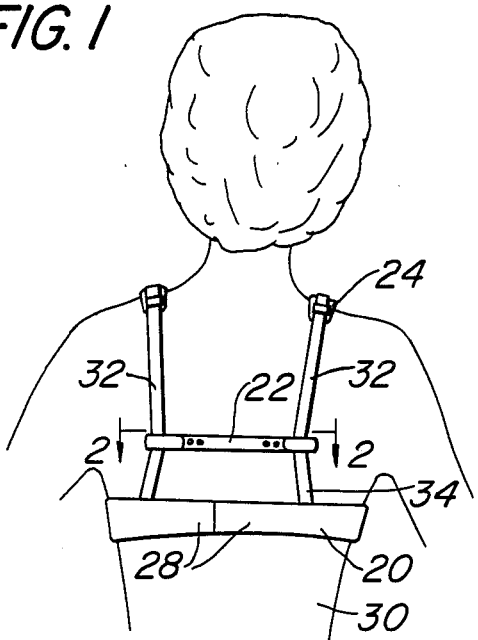
FIG. 11
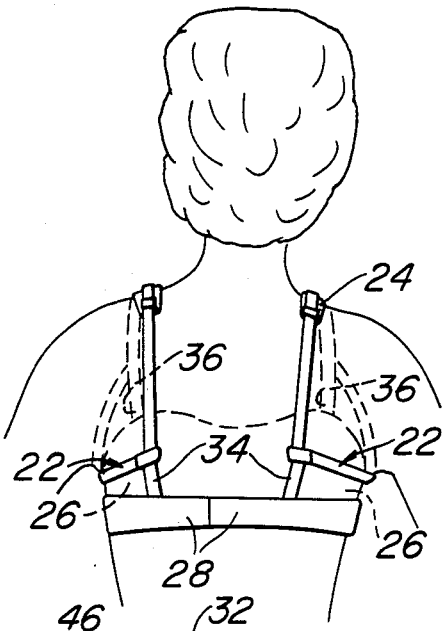
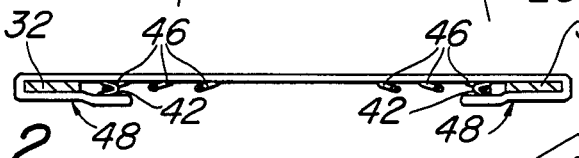
FIG. 2
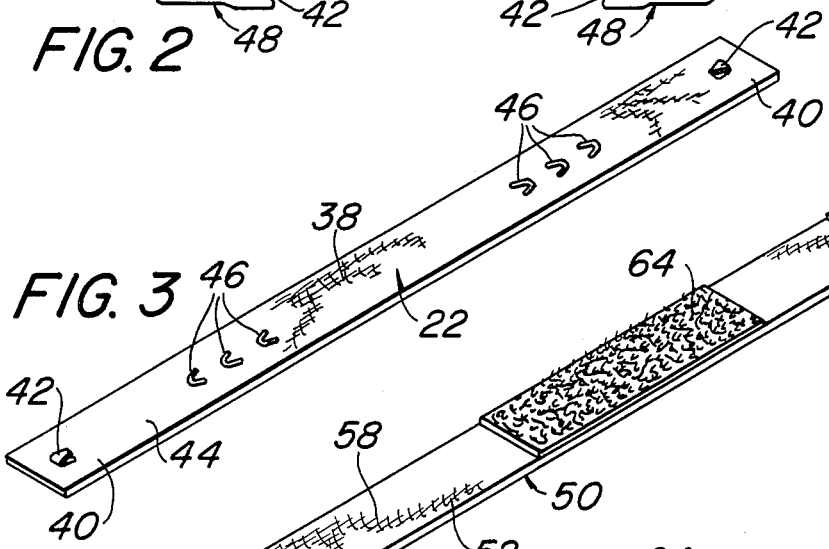
FIG. 3
FIG. 5
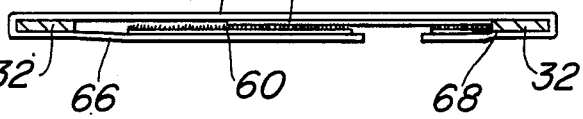
FIG. 4

FIG. 6
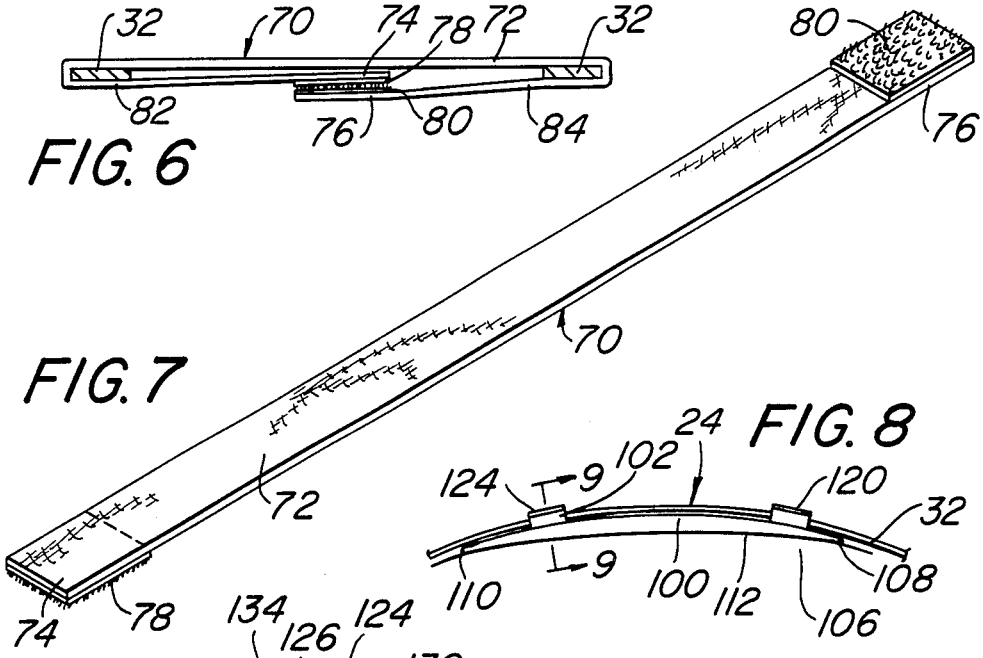
FIG. 7
FIG. 8
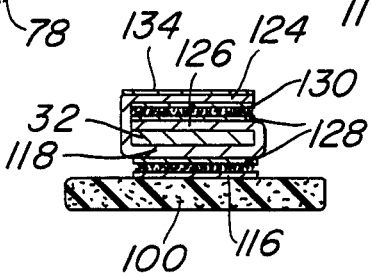
FIG. 9
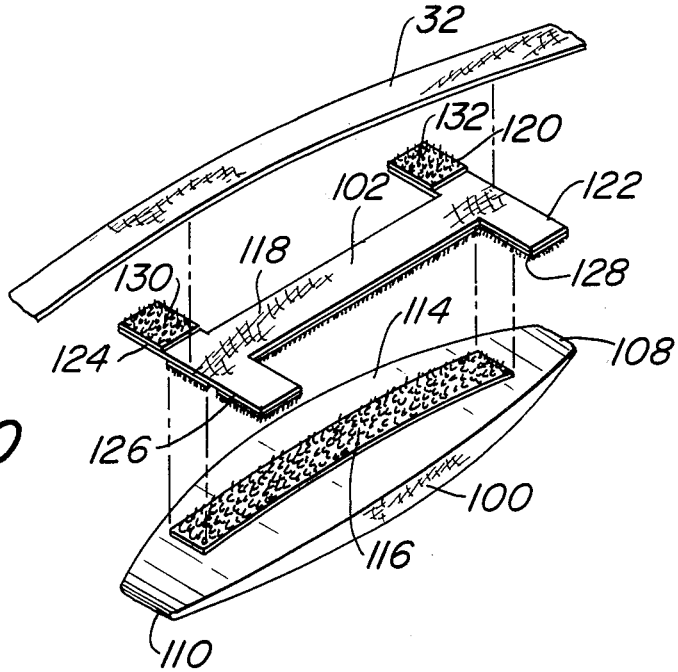
FIG. 10

COMFORT ACCESSORIES FOR BRASSIERES

BACKGROUND OF THE INVENTION

This invention relates generally to wearing apparel and more particularly to devices for use with brassieres to provide an extra measure of wearing comfort.

Various brassieres have been disclosed in the patent literature to provide a better fit to the body by providing means for adjusting the bra straps. For example, U.S. Pat. Nos. to Zweben 2,055,094, Garson 2,782,418 and Puliafico 2,882,907 all disclose brassieres in which the shoulder straps arranged to be hooked at different lateral positions along the back of the brassiere to vary the locations. In the U.S. Pat. No. 2,671,217 (Studler) there is disclosed a brassiere having a closure device located between the breast supporting cups. The shoulder straps are connected to the back strap immediately adjacent each other.

The Norwegian Pat. No. 74,089 discloses a brassiere having an additional strap secured to a member located between the breast cups. The additional strap includes adjustment means to enable it to incircle the body of the wearer to provide additional support for full-busted women.

While all of the foregoing devices may be useful for their intended purposes, they leave much to be desired from the standpoint of utility. In this connection all of the devices disclosed in the aforementioned patents require that they be included or built into the brassiere itself. Accordingly, adjustability for conventional brassieres remains a desired end. Moreover the devices of the aforementioned patents, as well as conventional brassieres, suffer from the inherent disadvantage that the narrow bra straps tend to dig in to the wearer's shoulders.

OBJECTS OF THE INVENTION

Accordingly, it is the general object of the instant invention to provide comfort accessories for conventional brassieres which overcome the disadvantages of the prior art.

It is another object of the instant invention to provide an accessory for conventional brassieres which enables any adjustment of the straps to accomodate a specific cut of an outer garment.

It is a further object of the instant invention to provide an accessory for conventional brassieres to enable the securement of the brassiere straps from their place on the shoulders in a desired position and to transfer areas of strain.

It is still a further object of the instant invention to provide an accessory for conventional brassieres for dissipating the pressure applied by the shoulder straps on the wearer's shoulders.

SUMMARY OF THE INVENTION

These and other objects of the instant invention are achieved by providing accessories for use in combination with the conventional brassiere having a pair of shoulder straps. The accessories comprise shoulder strap adjustment means and pressure diffusing means. The strap adjustment means is arranged for adjusting the position of at least one of the shoulder straps with respect to the wearer's shoulders and comprises an elongated flexible strip having loop means located at each end thereof. Each of the loop means is arranged to extend about and hold a portion of at least one of the shoulder straps, whereupon the position of the shoulder strap is adjusted with respect to the wearer's shoulder. The pressure diffusing means is arranged to spread the pressure applied by the shoulder strap across the wearer's shoulder and comprises pad means releasably secured to one of the shoulder straps. The pad means is interposed between the strap and the shoulder of the wearer.

DESCRIPTION OF THE DRAWING

Other objects and many of the attendant advantages of this invention will be readily appreciated as the same becomes better understood by reference to the detailed description when considered in connection with the accompanying drawing wherein:

FIG. 1 is a rear elevational view of a woman wearing a conventional brassiere on which are mounted the comfort producing accessories of the instant invention;

FIG. 2 is an enlarged sectional view taken along line 2—2 of FIG. 1;

FIG. 3 is an enlarged perspective view of the accessory shown in FIG. 2 laid flat;

FIG. 4 is a sectional view, like that of FIG. 2 but showing an alternative embodiment of an accessory;

FIG. 5 is a perspective view, like that of FIG. 3 but showing the alternative accessory of FIG. 4 laid flat;

FIG. 6 is a sectional view like FIGS. 2 and 4 but showing yet a third alternative embodiment of one of the accessories of the instant invention;

FIG. 7 is an enlarged perspective view like that of FIGS. 3 and 5 but showing the accessory of FIG. 6 laid flat;

FIG. 8 is an enlarged side elevational view of the pressure diffuser accessory constructed in accordance with the invention;

FIG. 9 an enlarged sectional view taken along line 9—9 of FIG. 8;

FIG. 10 is an enlarged exploded perspective view of the pressure diffusion accessory shown in FIG. 8; and FIG. 11 is a rear elevational view, like that FIG. 1 but showing an alternative use of the strap adjusting accessory of the subject invention.

DETAILED DESCRIPTION OF THE PREFERRED EMBODIMENT

Referring now to the figures of the drawing wherein like reference characters refer to like parts, there is shown at 20 a conventional brassiere on which are mounted one embodiment of a strap adjusting accessory 22 constructed in accordance with the subject invention and a strap pressure diffusing accessory 24 also constructed in accordance with the subject invention. The brassiere 20 is of a conventional construction and thus comprises a pair of cups 26 (FIG. 11), a pair of side panels each terminating in a rear strap 28, the free ends of each being arranged to be releasably secured together on the back 30 of the wearer, and a pair of shoulder straps 32. Each shoulder strap is an elongated member fixedly connected by its rear end 34 to an associated portion of back strap 28 of the brassiere and by its front end 36 (FIG. 11) to the portion of the brassiere contiguous with an associated cup 26.

The shoulder strap adjusting accessory of this invention is shown herein in three embodiments, namely the embodiments of FIGS. 2, 4 and 7. All of the embodiments are arranged to be used to secure the bra straps firmly in place on the shoulders of the wearer at a desired position, to transfer areas of strain, to keep the bra straps from slipping off the shoulders, and to accomodate the specific cut of an outer garment. As will be described hereinafter, a single adjusting accessory can be used to connect the two shoulder straps of a bra in the back or in the front of the wearer in order to alter the normal position of the straps on the shoulders in the interest of comfort or appearance. In addition, two adjusting accessories, each connecting a single bra strap under the arm of the wearer from front to back can be utilized to accomodate garments with low cut necklines or which are low on the shoulder.

Referring now to FIGS. 1, 2 and 3 one embodiment of the adjusting accessory will now be described. As can be seen that accessory is denoted by reference number 22 and basically comprises an elongated strap or strip of fabric 38 having a pair of ends 40. A hook member 42 is fixedly secured on one surface 44 of the strap 38 adjacent one end and a similar hook is fixedly secured on the same surface adjacent the other end. A plurality of loops or eyelets 46 are fixedly secured adjacent each of the hooks 42. In the embodiment shown in FIG. 2 there are three such eyelets 46 disposed adjacent each hook 42, with the eyelets being disposed at longitudinally spaced positions along the strap 38. The end portion 40 of the strap 38 is arranged to be bent over itself to form a loop 48 (FIG. 2) by the hook 42 engaging one of the associated eyelets 46. The loop 48 extends about the bra strap 32 to hold it therein. The plural spaced eyelets enable the length of the strap, that is the spacing between the two loops 48 to be adjusted as desired. Thus the two bra straps 32 and can be pulled to any desired spacing with respect to each other in the interest of comfort or appearance.

It must be pointed out at this juncture that the number of eyelets and their spacing is not limited to that shown herein. Thus other arrangements are contemplated to accomodate various bra sizes, etc.

In FIGS. 4 and 5 one alternative embodiment of the strap adjusting means 22 described heretofore is shown. That embodiment is denoted by the reference numeral 50 and basically comprises an elongated web or strip of fabric 52 having a first end 54 and a second end 56. Releasable securement means, of the hook and loop type, sold under the trademark "Velcro" by Velcro Company are fixedly secured to one surface 56 of the strip 52. Thus an elongated strip 60 of the hook-type component of the Velcro fastening system is fixedly secured to the end 54 of strip 52 on surface 58. A shorter strip or patch 62 of the same hook-type Velcro component is fixedly secured on the opposite end 56 of the strip 52 on its surface 58. A strip of the loop-type or plush component 64 of the Velcro fastening system is fixedly secured on the surface of the strip 52 at an intermediate portion therealong but closer to patch 62 than to strip 60. Each end of the strip 52 is arranged to be bent over itself to form a pair of loops for engaging the respective shoulder straps of the brassiere. To that end, the end 54 of the strip 52 is bent over itself so that a portion of the patch 60 engages the patch 64 to form loop 66. In a similar manner the end 56 of the strip is bent over itself so that patch 62 engages patch 64 to form loop 68. As can be seen loop 66 is substantially larger than loop 68. In fact loop 68 is arranged so that when it is formed it snugly encircles the bra strap 32 extending therethrough to hold the adjusting accessory 50 in place at an appropriate and desired height on the bra strap 32. Owing to the length of the Velcro components 60 and 64, the length of the accessory 50, that is the spacing between the loops, can be adjusted to any desired spacing in the interests of comfort and functionality.

In FIG. 7 there is shown yet a third alternative embodiment of the shoulder strap adjusting means of the instant invention. In the embodiment shown therein the shoulder strap adjusting means is denoted by the reference numeral 70 and basically comprises an elongated strip or web or fabric 72 having a pair of ends 74 and 76. A patch 78 of one component of a Velcro fastening system is fixedly secured to one surface of the strip 72 adjacent the end 74 while a patch 80 of the other component of the velcro fastening system is secured on the other surface of the strip 72 at the end 76. The strip 70 is arranged to be folded over itself to form a loop wherein the patch 78 engages the patch 80 (See FIG. 6) to form a pair of loop portions 82 and 84 each encircling a respective shoulder strap 32.

The shoulder strap adjusting accessory 22, 50 and 70 as described herein, can be used not only to connect the rear portion of each shoulder strap but can also be used to connect the front portions of both shoulder straps to adjust their position, if so desired.

Moreover, a pair of strap adjusting means constructed in accordance with any of the three aforementioned embodiments can be utilitzed to adjust the position of the shoulder straps by connecting each shoulder strap from its front to its rear as shown in FIG. 11. In such use each accessory 22 is disposed so that one of its loops 48 extends about one shoulder strap adjacent the rear connection point 34 while the other loop 48 extends about the front portion of the shoulder strap adjacent the front connection point 36 and with the remaining portion of the accessory being disposed under the arm of the wearer. The spacing between the loops can be adjusted to tighten or loosen the shoulder strap on the wearer. Moreover, as will be appreciated by those skilled in the art, the use of a pair of adjustment accessories 22, 50 or 70, like that shown in FIG. 11 enables the adjustment of the shoulder straps to accomodate garments of low cut or low shoulder necklines.

It must be pointed out at this juncture that the types of fastening members utilized to form the loops of the accessories 22, 50 and 70 described heretofore are merely exemplary and other closures or fasteners, e.g., snaps, buttons, etc., can be used.

In order to prevent the development of shoulder indentations caused by the shoulder straps digging into the shoulders of the wearer the brassiere 20 includes mounted thereon a pair of pressure diffusing accessories 24. The details of the pressure diffusing accessories 24 can best be seen with reference to FIGS. 8–10. As can be seen therein the accessory 24 basically comprises an arcuate pad member 100 and fastening means 102 therefor. The pad 100 is formed of flexible cushiony material and is of generally arcuate shape when viewed from the side, like that in FIG. 8, with the curvature being such as to approximate the curvature of a typical woman's shoulder 106. As can be seen the front and rear portions 108 and 110 respectively of the pad 100 are tapered. The pad includes a bottom surface 112 which is arranged to be disposed on the wearer's shoulder 106 and an upper surface 114. The upper surface 114 includes a strip 116 of the loop-type component of a Velcro fastening system fixedly secured thereon. The strip 116 is arranged to be releasably secured to the fastening means 102 to hold the pad 100 in place under the shoulder strap 32 so that it is interposed between the shoulder strap and the shoulder. The fastening means 102 is arranged to be releasable secured to the shoulder strap 32. To that end the means 102 is of generally "I-shape" having an elongated central portion 118 from which a pair of tabs 120 and 122 project at one end and from which a pair of tabs 124 and 126 project from the other end.

The underside of portion 118 of fastening means 102 as well as the underside of the two tab portions 122 and 126 have fixedly mounted thereon a covering 128 formed of the loop-type component of the Velcro fastening system. A patch 130 of the hook-type Velcro component is mounted on the other surface of the fastening means 122 at the tab portion 124 and a similar patch 132 is mounted on the same side of the fastening member 122 at tab 120.

The fastening means 102 is arranged to be releasably secured to the brassiere's shoulder strap by disposing it under the shoulder strap with central portion 118 lying along the strap. The tabs 120 and 122 are bent around the shoulder strap to encircle the strap and so that Velcro component 132 engages a portion of Velcro component 128. In a similar manner the tabs 124 and 126 are bent around the strap so that Velcro component 124 engages another portion of Velcro component 128. As will be appreciated from the foregoing the encirlement of the tab portions about the shoulder strap 32 releasably secures the fastening means 102 in place on the bra strap and against sliding action therealong. The use of Velcro fastening means ensures that the securement of the fastening means 102 to the shoulder strap can be effected quickly and easily and irrespective of the width of the shoulder strap 32.

As can be seen in FIG. 9 a strip of satin or other smooth fabric 134 is fixedly secured to the tab portions 120 and 124 on the opposite sides of the patches 132 and 130, respectively, to provide a smooth and attractive surface which will not accidently catch on the wearer's outer garment. Moreover, in the interest of wearing comfort the extent or width of loop-type Velcro fastening components covering 128 is chosen to be slightly more than the width of the strip 118 and tabs 132 and 130 to which it secures so that the hooks of Velcro portions 132 and 130 do not project exposed towards the shoulder. So too, the extent or width of the hook-type Velcro fastening components covering 130 and 132 is slightly less than the width of the portions 122 and 126 to which they are secured so that the hooks do not project towards the shoulder, also in the interest of wearing comfort.

As will be appreciated by those skilled in the art with the fastening means 102 secured to the shoulder strap 32 as described above its Velcro component portion 128 extends along the underside of strip 118 and is exposed for releasable engagement by the Velcro strip 116 on the upper side of the pad 110. Thus the pad can be releasably secured to the strap mounted fastener 102, to hold it in place over the wearer's shoulder. By virture of the wide extent of the pad 110 with respect to the width of the shoulder strap to which it is secured, the pressure applied by the shoulder strap is diffused across the shoulder 106 of the wearer, thereby rendering the wearing of the brassiere 20 much more comfortable.

As with the other accessories described heretofore, the accessory 24 can be constructed utilizing alternative fastening means in lieu of the Velcro fastening means shown and described. Thus, snaps, buttons, hooks, etc. can be used if desired.

As will be appreciated from the foregoing the strap adjusting accessories as well as the pressure diffusing accessory of the instant invention provide means for customizing a conventional brassiere to provide maximum comfort and appearance. Moreover, the accessories of the instant invention can be used singly or in combination with each other, depending on the needs of the wearer.

Without further elaboration, the foregoing will so fully illustrate my invention that others may, by applying current or future knowledge, readily adopt the same for use under various conditions of service.

I claim:

1. In combination with the conventional brassiere having a pair of shoulder straps each having a front and rear portion, the improvement comprising strap adjusting means, said strap adjusting means being arranged for adjusting the position of at least one of said shoulder straps with respect to the wearer's shoulders and comprising a non-elastic elongated flexible strip having loop means located at each end thereof, said strip being arranged for mounting on either the front or rear portions of both of said shoulder straps, with each of said loop means extending about and holding said front or rear portion of both of said shoulder straps, said strip also being arranged for mounting on the front and rear portions of one of said shoulder straps and extending under the wearer's arm, both ends of said loop means extending about and holding said rear portion of one of said straps and the other of said loop means extending about and holding the front portion of said one shoulder strap, the length of said strip being adjustable, whereupon the position of the associated shoulder strap can be adjusted to any desired position with respect to said shoulder.

2. The combination of claim 1, wherein said flexible strip comprises a thin web of non-elastic material having releaseable securement means located adjacent each end thereof to enable both end portions of said strip to be formed into said loop means.

3. The combination of claim 2, wherein said releaseable securement means comprises a pair of components, said components being a hook component and a loop component.

4. The combination of claim 3, wherein each end of said strip includes one of said pair of components, with one component thereof being disposed adjacent the associated end of said strip and the other component thereof being disposed closer to the middle of said strip.

5. The combination of claim 4, wherein plural of said other components are mounted at spaced locations along said strip toward the middle of said strip whereupon said one component can be brought into engagement with any of said other components to enable adjustment of the size of said loop means.

6. The combination of claim 5, wherein said one component a hook element and wherein said other component comprises a loop element.

* * * * *